US010801345B2

(12) United States Patent
Clum et al.

(10) Patent No.: US 10,801,345 B2
(45) Date of Patent: Oct. 13, 2020

(54) CHEVRON TRIP STRIP

(71) Applicant: United Technologies Corporation, Farmington, CT (US)

(72) Inventors: Carey Clum, East Hartford, CT (US); Dominic J. Mongillo, West Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/272,646

(22) Filed: Feb. 11, 2019

(65) Prior Publication Data

US 2019/0186278 A1 Jun. 20, 2019

Related U.S. Application Data

(63) Continuation-in-part of application No. 15/019,197, filed on Feb. 9, 2016, now Pat. No. 10,202,864.

(51) Int. Cl.
*F01D 25/12* (2006.01)
*F01D 11/00* (2006.01)
*F01D 11/12* (2006.01)

(52) U.S. Cl.
CPC ..... *F01D 11/001* (2013.01); *F01D 11/122* (2013.01); *F01D 25/12* (2013.01);
(Continued)

(58) Field of Classification Search
CPC ..... F01D 11/001; F01D 11/122; F01D 25/12; F05D 2240/11; F05D 2240/55;
(Continued)

(56) References Cited

U.S. PATENT DOCUMENTS 5,375,973 A * 12/1994 Sloop ..... F01D 11/08 415/115
5,486,090 A * 1/1996 Thompson ..... F01D 11/08 415/173.1

(Continued)

FOREIGN PATENT DOCUMENTS

EP 2570613 A2 3/2013
EP 3133254 A1 2/2017

(Continued)

OTHER PUBLICATIONS

Extended European Search Report for Application No. 17155445.4-1610 dated Jun. 14, 2017 (9 pp.).

*Primary Examiner* — Igor Kershteyn
(74) *Attorney, Agent, or Firm* — Cantor Colburn LLP

(57) ABSTRACT

A blade outer air seal segment assembly includes a blade outer air seal segment configured to connect with an adjacent blade outer air seal segment to form part of a rotor shroud. A cooling channel is disposed in the first turbine blade outer air seal segment. The cooling channel extends at least partially between a first circumferential end portion and a second circumferential end portion. At least one inlet aperture provides a cooling airflow to the cooling channel. A series of trip strips in the cooling channel cause turbulence in the cooling airflow. The trip strips include at least one chevron shaped trip strip having a first and second leg joined at an apex arranged adjacent the inlet aperture. The trip strips also include at least one trip strip having a single skewed line.

20 Claims, 9 Drawing Sheets

(52) U.S. Cl.
CPC ..... *F05D 2240/11* (2013.01); *F05D 2240/55* (2013.01); *F05D 2260/203* (2013.01); *F05D 2260/2212* (2013.01); *F05D 2260/22141* (2013.01)

(58) Field of Classification Search
CPC ..... F05D 2260/203; F05D 2260/2212; F05D 2260/22141
See application file for complete search history.

(56) References Cited

U.S. PATENT DOCUMENTS

| | | | | |
|---|---|---|---|---|
| 5,538,393 | A * | 7/1996 | Thompson | F01D 11/08 415/115 |
| 5,609,469 | A | 3/1997 | Worley et al. | |
| 2009/0226300 | A1* | 9/2009 | Knapp | F01D 5/18 415/116 |
| 2013/0071227 | A1* | 3/2013 | Thibodeau | F01D 9/04 415/1 |
| 2014/0047843 | A1* | 2/2014 | Papple | F01D 25/12 60/726 |
| 2015/0377029 | A1 | 12/2015 | Blake et al. | |
| 2016/0319698 | A1* | 11/2016 | Romanov | F01D 11/24 |
| 2017/0051623 | A1* | 2/2017 | Romanov | F01D 25/12 |
| 2017/0226885 | A1* | 8/2017 | Clum | F01D 11/08 |

FOREIGN PATENT DOCUMENTS

| | | | |
|---|---|---|---|
| WO | 2014028418 | A1 | 2/2014 |
| WO | 2015130380 | A2 | 9/2015 |

* cited by examiner

CHEVRON TRIP STRIP

CROSS REFERENCE TO RELATED APPLICATIONS

This application is a continuation-in-part of U.S. application Ser. No. 15/019,197 filed Feb. 9, 2016, the disclosure of which is incorporated by reference herein in its entirety.

BACKGROUND

This disclosure relates to a gas turbine engine, and more particularly to a cooling passage that may be incorporated into a gas turbine engine component.

Blade outer air seal (BOAS) segments may be internally cooled by bleed air. For example, there may be an array of cooling passageways within the BOAS. Cooling air may be fed into the passageways from the outboard OD side of the BOAS (e.g., via one or more inlet ports). The cooling air may exit through the outlet ports.

BRIEF DESCRIPTION

In some aspects of the disclosure, a blade outer air seal segment assembly includes a blade outer air seal segment configured to connect with an adjacent blade outer air seal segment to form part of a rotor shroud. A cooling channel is disposed in the first turbine blade outer air seal segment. The cooling channel extends at least partially between a first circumferential end portion and a second circumferential end portion. At least one inlet aperture provides a cooling airflow to the cooling channel. A series of trip strips in the cooling channel cause turbulence in the cooling airflow. The trip strips include at least one chevron shaped trip strip having a first and second leg joined at an apex arranged adjacent the inlet aperture. The trip strips also include at least one trip strip having a single skewed line.

In addition to one or more of the features described above, or as an alternative, further embodiments may include that the series of trip strips includes a plurality of chevron shaped trip strips, said plurality of chevron shaped trip strips being substantially identical.

In addition to one or more of the features described above, or as an alternative, further embodiments may include that said series of trip strips includes a plurality of chevron shaped trip strips, wherein at least one of said plurality of chevron shaped trip strips is substantially different.

In addition to one or more of the features described above, or as an alternative, further embodiments may include that the at least one single skewed line trip strip is arranged generally parallel to one of the first leg and the second leg of the at least one chevron shaped trip strip.

In addition to one or more of the features described above, or as an alternative, further embodiments may include that the at least one single skewed line trip strip is arranged generally at an angle to the first leg and the second leg of the at least one chevron shaped trip strip.

In addition to one or more of the features described above, or as an alternative, further embodiments may include that the at least one single skewed line trip strip is arranged downstream from said at least one chevron shaped trip strip with respect to said cooling airflow.

In addition to one or more of the features described above, or as an alternative, further embodiments may include a configuration of the plurality of chevron shaped and skewed line trip strips minimize and/or eliminate local cavity regions exhibiting flow recirculation and/or regions of stagnated flow of the cooling air within the cooling channel.

In addition to one or more of the features described above, or as an alternative, further embodiments may include that said series of trip strip directs said cooling airflow toward at least one outlet aperture associated with said cooling channel.

In addition to one or more of the features described above, or as an alternative, further embodiments a ratio of a height of said trip strips to a height of said cooling channel is between about 0.1 and 0.5.

In addition to one or more of the features described above, or as an alternative, further embodiments may include that the blade outer air seal is a portion of a turbine.

In addition to one or more of the features described above, or as an alternative, further embodiments may include that the at least one inlet aperture includes a discrete feed hole, and the chevron shaped trip strips extend from the discrete feed hole a distance of up to about ten times a diameter of the discrete feed hole.

In addition to one or more of the features described above, or as an alternative, further embodiments may include that the at least one inlet aperture includes a side inlet, and the chevron shaped trip strips extend from the side inlet a distance of up to about ten times a radial height of the side inlet.

In some aspects of the disclosure, a gas turbine engine includes a compressor section, a turbine section, and a gas turbine engine component having a first wall providing an outer surface of the gas turbine engine component and a second wall spaced apart from the first wall. The first wall is a gas path wall exposed to a core flow path of the gas turbine engine and the second wall is a non-gas path wall. A cooling channel is provided between the second wall and the first wall. A plurality of trip strips extends from adjacent one of the first wall and the second wall into a cooling airflow within the cooling channel. The plurality of trip strips include at least one chevron shaped trip strip having a first leg and a second leg joined together at an apex configured to direct said cooling airflow across an entire width of the cooling channel and at least one trip strip having a single skewed line.

In addition to one or more of the features described above, or as an alternative, further embodiments may include said gas turbine engine component includes a blade outer air seal.

In addition to one or more of the features described above, or as an alternative, further embodiments may include said gas turbine engine component includes at least one of an airfoil, a gas path end-wall, a stator vane platform end wall, and a rotating blade platform.

In addition to one or more of the features described above, or as an alternative, further embodiments may include the at least one single skewed line trip strip is arranged downstream from said at least one chevron shaped trip strip with respect to said cooling airflow.

In addition to one or more of the features described above, or as an alternative, further embodiments may include the at least one chevron shaped trip strip is arranged within an impingement zone adjacent at least one inlet aperture.

In addition to one or more of the features described above, or as an alternative, further embodiments may include the at least one inlet aperture includes a discrete feed hole, and the chevron shaped trip strips extend from the discrete feed hole a distance of up to about ten times a diameter of the discrete feed hole.

In addition to one or more of the features described above, or as an alternative, further embodiments may include the at least one inlet aperture includes a side inlet, and the chevron shaped trip strips extend from the side inlet a distance of up to about ten times a radial height of the side inlet.

In addition to one or more of the features described above, or as an alternative, further embodiments may include a configuration of the plurality of chevron shaped and skewed line trip strips minimize and/or eliminate local cavity regions exhibiting flow recirculation and/or regions of stagnated flow of the cooling airflow within the cooling channel.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
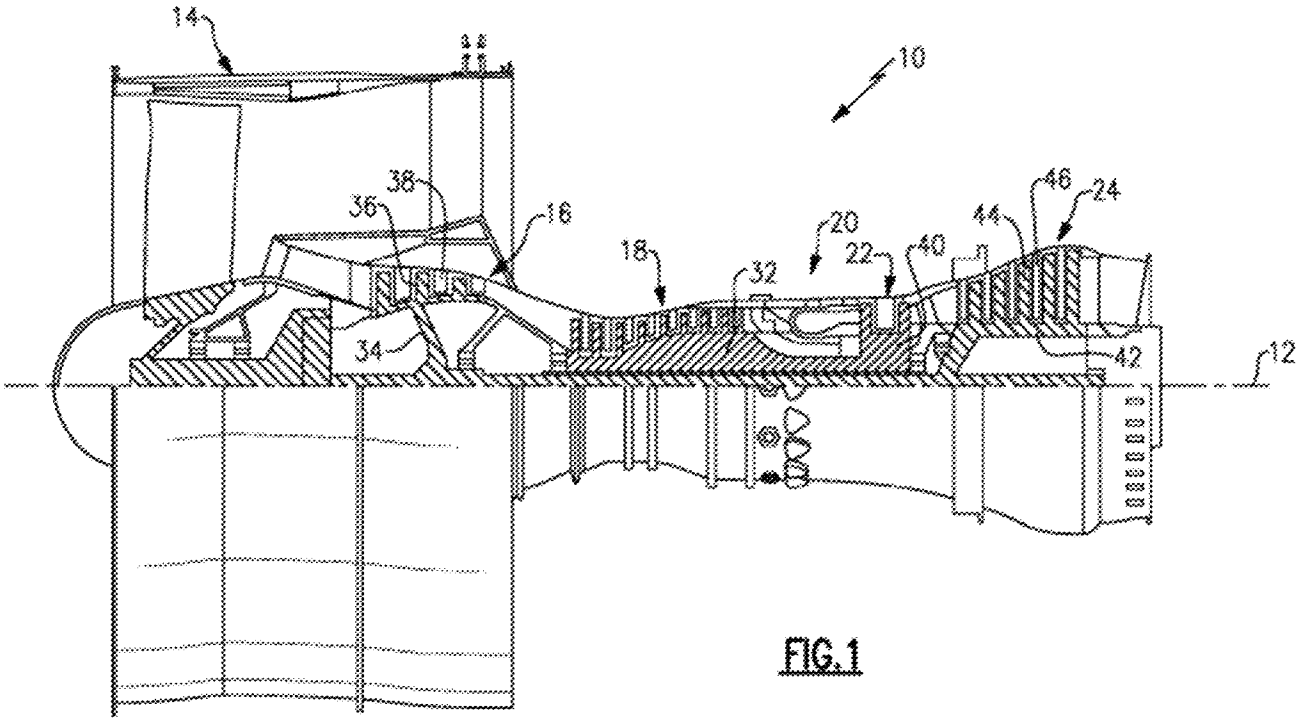
FIG. 1 is a schematic cross-section of an example of a gas turbine engine.

Referring now to FIG. 1, an example of a gas turbine engine 10 circumferentially disposed about an axis 12 is illustrated. The gas turbine engine 10 includes a fan section 14, a low pressure compressor section 16, a high-pressure compressor section 18, a combustor section 20, a high-pressure turbine section 22 and a low pressure turbine section. Alternative engines may include fewer or more sections, such as an augmentor section (not shown) for example, among other systems or features.

During operation, air is compressed in the low pressure compressor section 16 and the high-pressure compressor section 18. The compressed air is then mixed with fuel and burned in the combustion section 20. The products of combustion are expanded across the high-pressure turbine section 22 and the low pressure turbine section 24.

The high-pressure compressor section 18 and the low pressure compressor section 16, include rotors 32 and 34, respectively. The rotors 32, 34 are configured to rotate about the axis 12. The example rotors 32, 34 include alternating rows of rotatable airfoils or blades 36 and static airfoils or blades 38.

The high-pressure turbine section 22 includes a rotor 40 that is rotatably coupled to the rotor 32. The low pressure turbine section 24 includes a rotor 42 that is rotatably coupled to the rotor 34. The rotors 40, 42 are configured to rotate about the axis 12 to drive the high-pressure and low pressure compressor sections 18, 16. The example rotors 40, 42 include alternating rows of rotatable airfoils or blades 44 and static airfoils or vanes 46.

The gas turbine engine 10 is not limited to the two-spool turbine architecture described herein. Other architectures, such as a single-spool axis design, a three-spool axial, design for example, are also considered within the scope of the disclosure.

Figure 2:
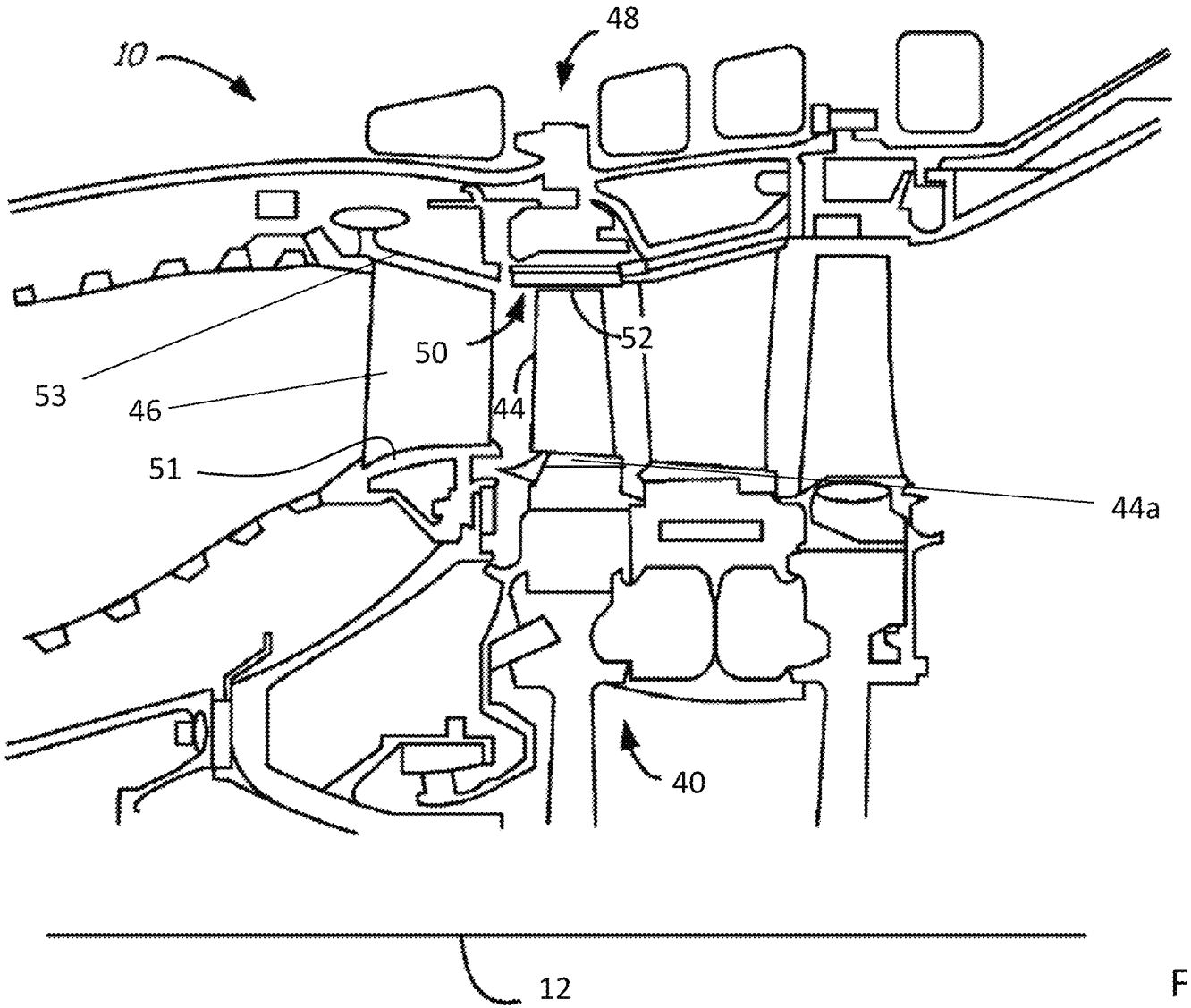
FIG. 2 is a detailed cross-section of a high-pressure turbine section of the gas turbine engine of FIG. 1.
Figure 3:
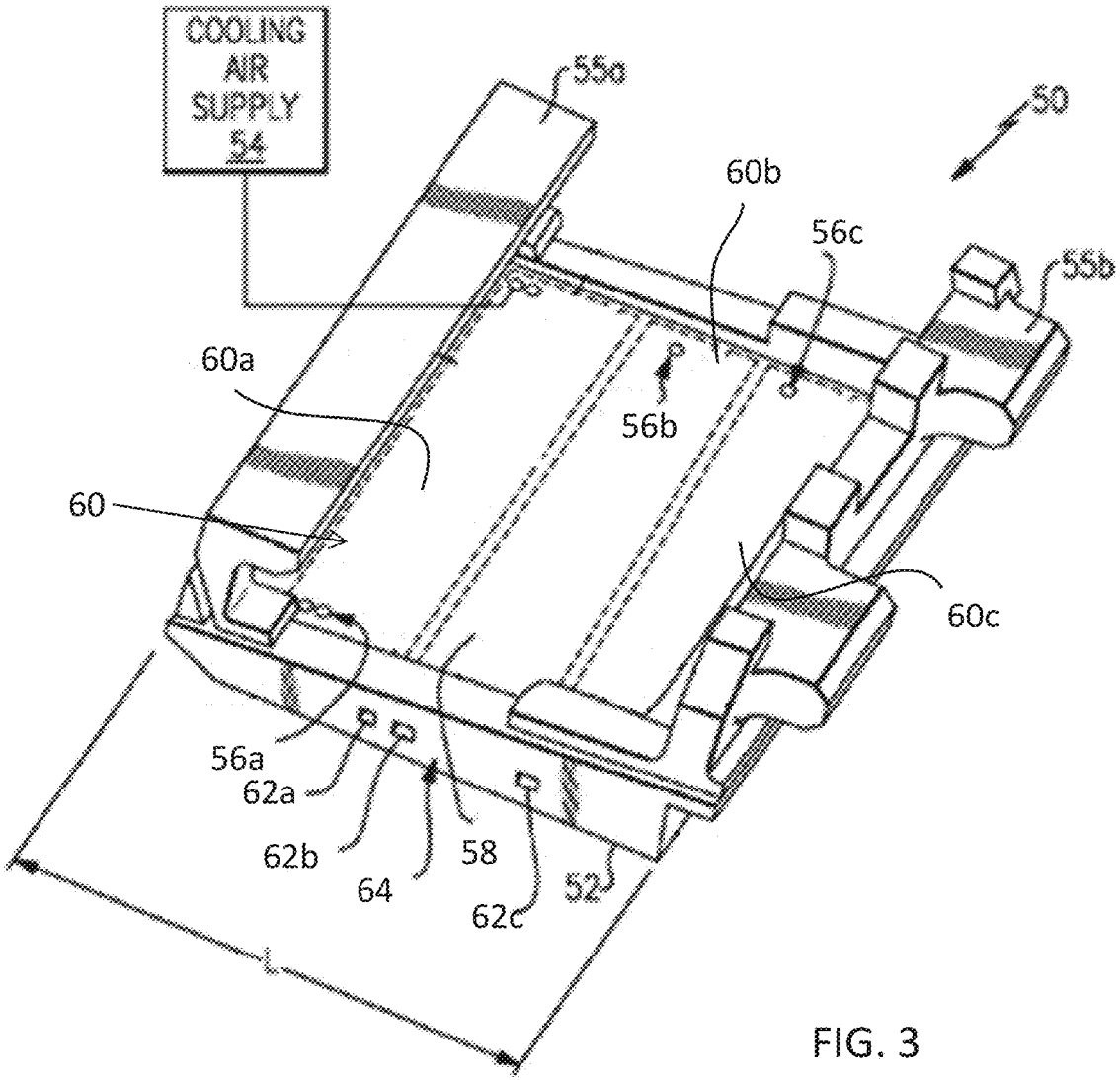
FIG. 3 is a perspective view of an example of a blade outer air seal of the gas turbine engine.

Referring now to FIGS. 2 and 3, and with continued reference to FIG. 1, an example of a blade outer air seal (hereinafter "BOAS") 50 suspended from an outer casing 48 of the gas turbine engine 10 is illustrated. As shown in FIG. 2, the BOAS 50 is disposed between a plurality of rotor blades 44 of the rotor 40 within the high-pressure turbine section 22. During operation of the engine 10, an inwardly facing surface 52 of the illustrated BOAS exposed to a gas path, interfaces with and seals against the tips of the rotor blades 44 in a known manner. A plurality of BOASs together, form an outer shroud of the rotor 40.

Attachment structures are used to secure the BOAS 50 within the engine 10. The attachment structures in this example include a leading hook 55*a* and a trailing hook 55*b*. The BOAS 50 is one of a plurality of BOASs that circumscribe the rotor 40. The BOAS 50 establishes an outer diameter of the core flow path through the engine 10. Other areas of the engine 10 include other circumferential ring arrays of BOASs that circumscribe a particular stage of the engine 10.

Figure 5A:
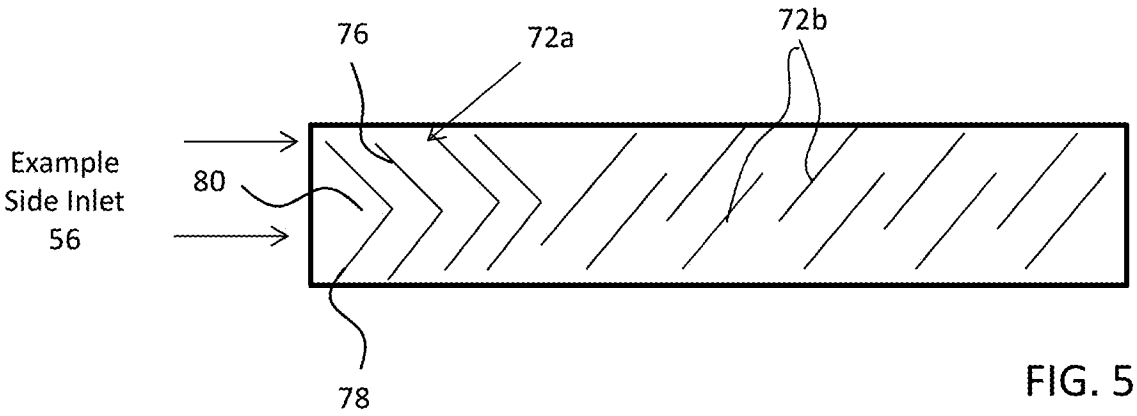
FIGS. 5*a*-5*e* are top views of various configurations of the plurality of trip strips within a channel according to an embodiment.

Cooling air is moved through the BOAS 50 to communicate thermal energy away from the BOAS 50. The cooling air is supplied from a cooling air supply 54 through one or more inlet apertures 56, such as inlet holes (56A, 56B, 56C) established in an outwardly facing surface 58 of the BOAS 50 (as shown in FIG. 3), or a side inlet opening 56 (see FIG. 5*a*) formed at a circumferential end portion of the BOAS adjacent a side of the channel 60 for example. In one embodiment, the cooling air supply 54 is located radially outboard from the BOAS 50. It should be understood that the inlet apertures described herein may have any applicable geometry, including, but not limited to spherical, elliptical, race-track, teardrop, and other non-cylindrical geometries for example.

Figure 4A:
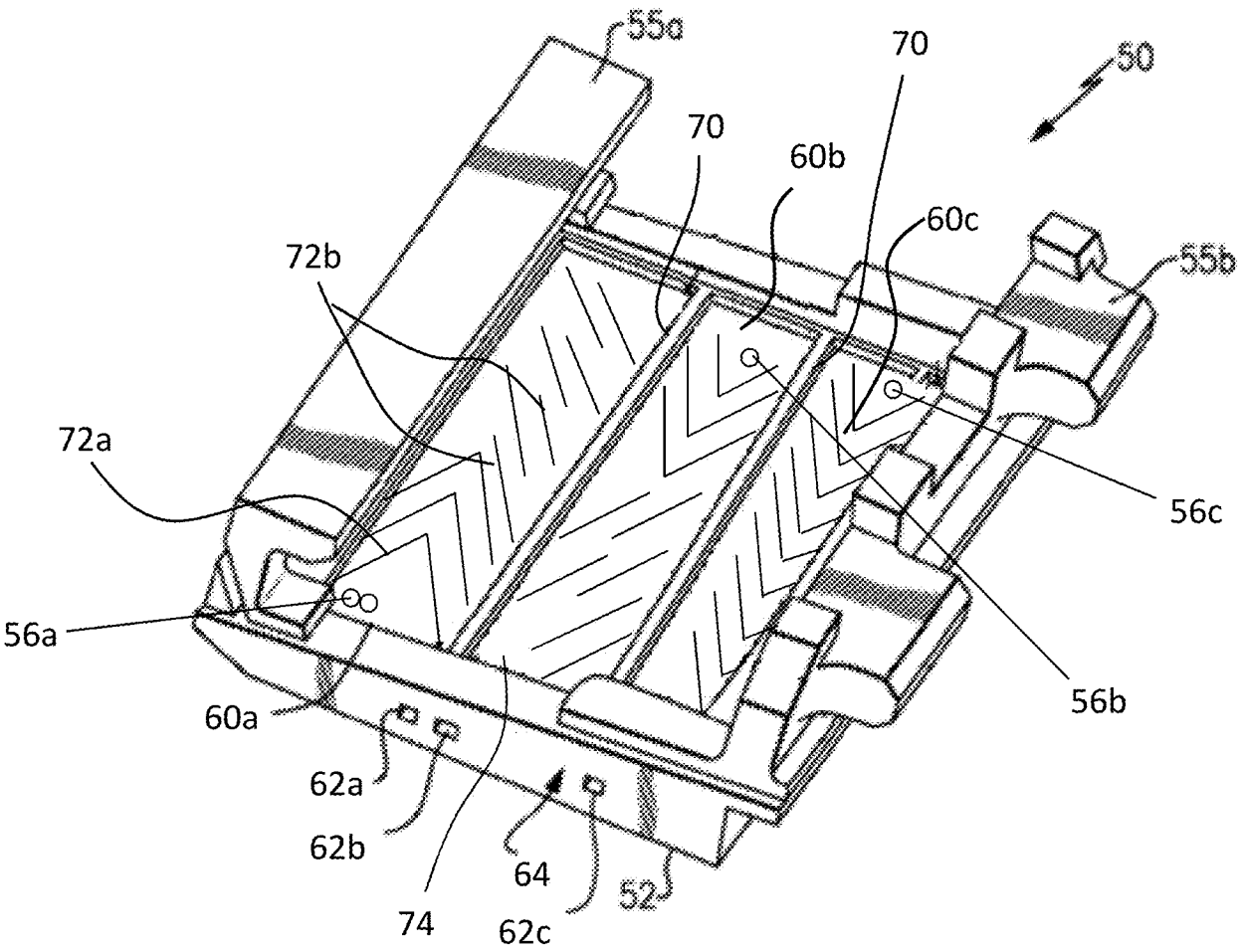
FIGS. 4*a*-4*b* are a perspective views of the blade outer air seal of FIG. 3 at a radial cross-section through the cooling channels.

With reference to FIG. 4A and continued reference to FIG. 3, cooling air moves through the inlet apertures 56 into one or more channels or cavities 60 established within the BOAS 50. In the illustrated, non-limiting embodiment, cooling air is configured to move radially from inlet aperture 56*a* into a first channel 60*a*, from inlet aperture 56*b* to a second channel 60*b*, and from inlet aperture 56*c* to a third channel 60*c*. A BOAS 50 having any number of channels 60 and any number of side or discrete hole inlet apertures 56 associated with each channel 60 is within the scope of the disclosure. Once the cooling air is arranged within the channels 60, the cooling air is not free to move between channels 60.

The cooling air exits the BOAS 50 through outlet apertures 62 (shown as 62A, 62B, 62C), such as holes for example, which are established in a circumferential end portion 64 of the BOAS 50. In the illustrated, non-limiting embodiment, one or more outlet apertures 62 are configured to communicate cooling air away from a corresponding channel 60. For example, at least one outlet aperture 62*a* is configured to remove cooling air from the first channel 60*a*, at least one outlet aperture 62*b* is configured to remove cooling air from the second channel 60*b*, and at least one outlet aperture 62*c* is configured to remove cooling air from the third channel 60*c*.

The cooling air moves circumferentially as the cooling air exits the BOAS 50 through the outlet aperture 62. As the cooling air exits the channels 60 of the BOAS 50, the cooling air contacts a circumferentially adjacent BOAS within the engine 10. In one embodiment, the BOAS 50 interfaces with a circumferentially adjacent BOAS through a shiplapped joint.

The BOAS 50 may include one or more features configured to manipulate the flow of cooling air through the channels 60 therein. Such features include axially extending barriers (not shown), circumferentially extending barriers 70, and trip strips 72. The axially and circumferentially extending barriers 70 may project radially from an inner diameter surface 74 and contact a portion of the BOAS 50 opposite the outwardly facing surface 58. The circumferentially extending barriers 70 are designed to maximize heat transfer coefficients in the channels 60. Although the circumferentially extending barriers 70 are illustrated in the FIGS. as being generally parallel to one another, embodiments where one or more of the barriers 70 are tapered are within the scope of the disclosure.

Figure 4B:
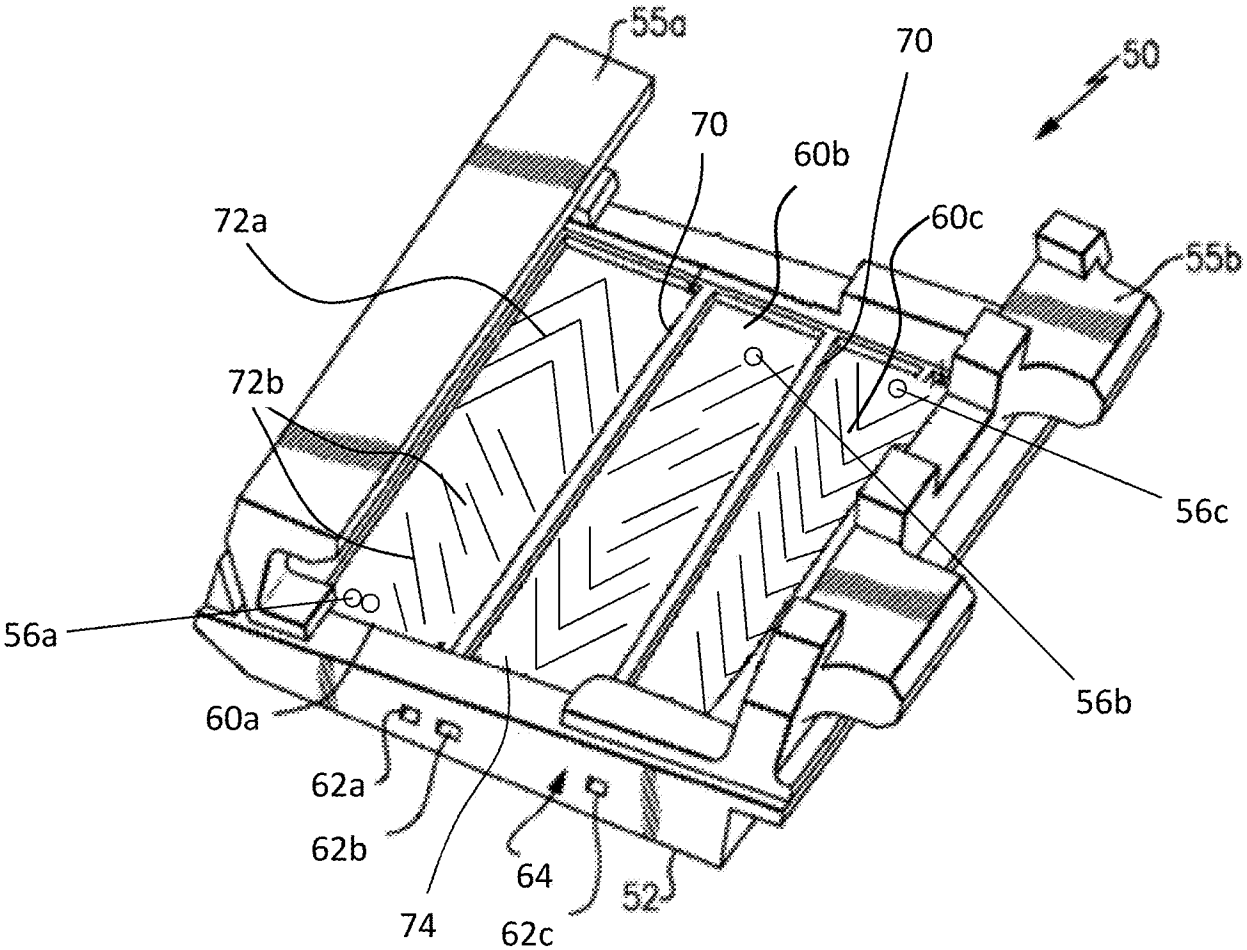

Again referring to FIG. 4A, as shown, one or more trip strips generally referred to as 72 may be positioned within the channels 60 of the BOAS 50. The trip strips 72 project radially from the inner diameter surface 74 into the channel 60. In the embodiment of FIG. 4A, with respect to the flow within the channels 60*a* and 60*b* and the location of the inlet holes 56*a* and 56*b*, the chevron shaped trip strips 72*a* are upstream of the skewed line trip strips 72*b*. In one embodiment, illustrated in FIG. 4B, with respect to the flow within the channel 60*a* and the location of the inlet hole 56*a*, the chevron shaped trip strips 72*a* may be downstream of the skewed line trip strips 72*b*. In addition, or as an alternate, as illustrated in FIG. 4B, with respect to the flow within the channel 60*b* and the location of the inlet hole 56*b*, the chevron shaped trip strips 72*a* may be downstream of the skewed line trip strips 72*b*. The configuration of FIG. 4B is not intended to be limiting.

Figure 6A:
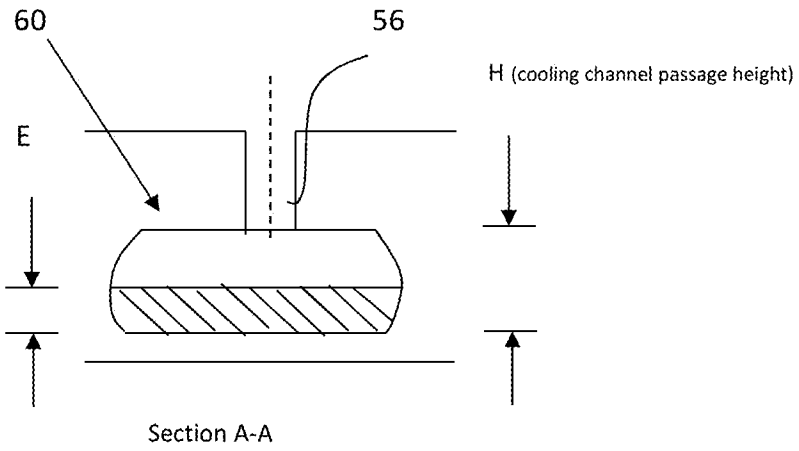
FIGS. 6*a* and 6*b* are cross-sectional views of the cooling channel of FIG. 5*b* taken along lines A-A and B-B, respectively according to an embodiment.
Figure 6B:
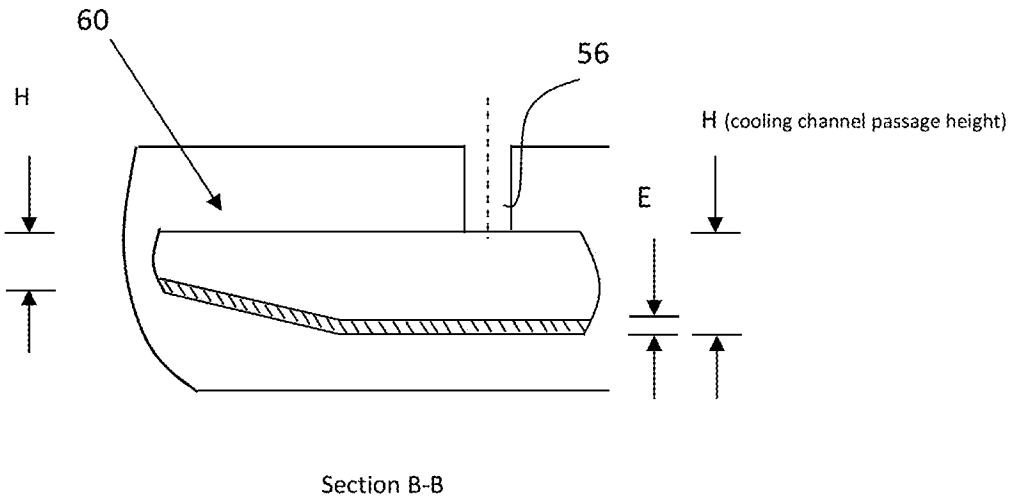

With reference additionally to FIGS. 6A and 6B, the height of each trip strip 72 may vary, or alternatively, may be substantially uniform. Further, the contour and/or height of the plurality of trip strips 72 may be substantially identical, or may be different. However, the trip strips 72 do not extend fully from the inner diameter surface 74 to opposite the outwardly facing surface 58. In one embodiment, the ratio of the height E of the trip strips 72, to the height H of the cooling channel 60 is between about $0.01 \leq E/H \leq 0.5$.

The trip strips 72 are intended to generate turbulence within the cooling airflow as it is communicated through the channels 60 to improve the heat transfer between the BOAS 50 and the cooling airflow. The trip strips 72 may be formed through any of a plurality of manufacturing methods, including but not limited to additive manufacturing, laser sintering, a stamping and/or progressive coining process, such as with a refractory metal core (RMC) material, a casting process or another suitable processes for example. Alternatively, the trip strips 72 may be fabricated from a core die through which silica and/or alumina, ceramic core body materials are injected to later form trip strip geometries as part of the loss wax investment casting process.

With reference now to FIGS. 4A, 5A-5E, and 6A and 6B, in the illustrated, non-limiting embodiment, at least one of the trip strips 72 includes a first leg 76 and a second leg 78 joined together at an apex 80 to form a chevron shaped feature. At least one of the first leg 76 and second leg 78 of the chevron shaped trip strip 72*a* extends towards and optionally contacts a boundary of the channel, such as formed by the circumferentially or axially extending barriers 70. In embodiments including a plurality of chevron shaped trip strips 72*a*, the chevron shaped trip strips 72*a* may be substantially identical, or alternatively, may have different configurations. In addition, one or more of the trip strips 72 may include a skewed line, arranged at an angle to the path defined by the cooling channel 60. The skewed line trip strips 72*b* may be arranged parallel to or at different angles than the first and second legs of the chevron shaped trip strips 72*a*. In one embodiment, the one or more skewed line trip strips 72*b* are arranged downstream from one or more of the chevron shaped trip strips 72*a* with respect to the direction of cooling air flow through the cooling channel 60. More specifically, the trip strips 72 may transform from chevron shaped to a skewed or segmented skewed configuration downstream from the inlet supply aperture 50 impingement zone of the cooling channel 60.

Figure 5B:
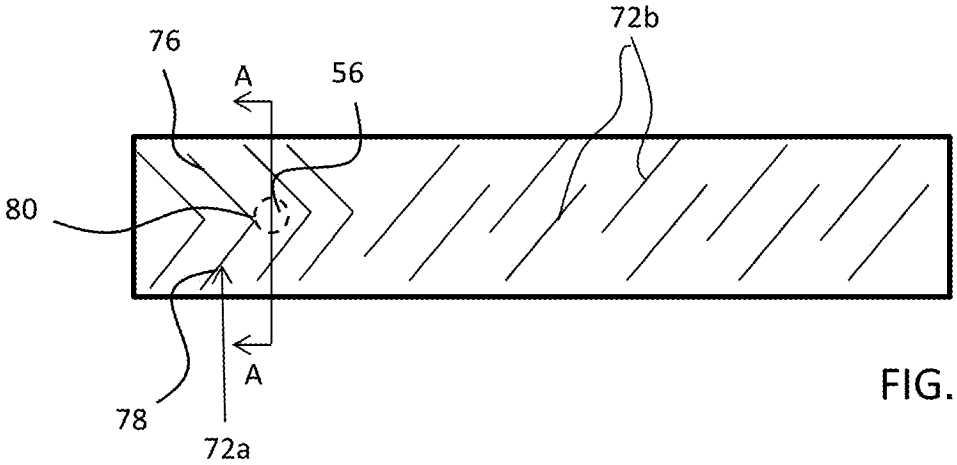
Figure 5C:
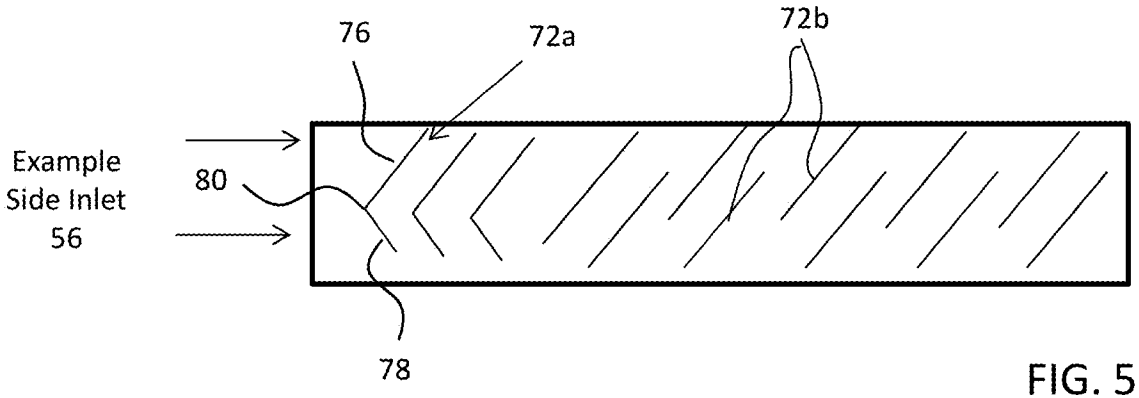
Figure 5D:
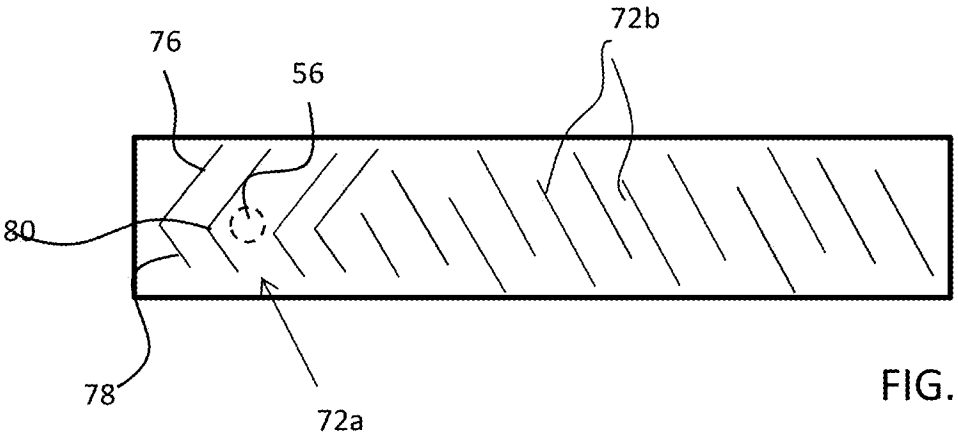
Figure 5E:
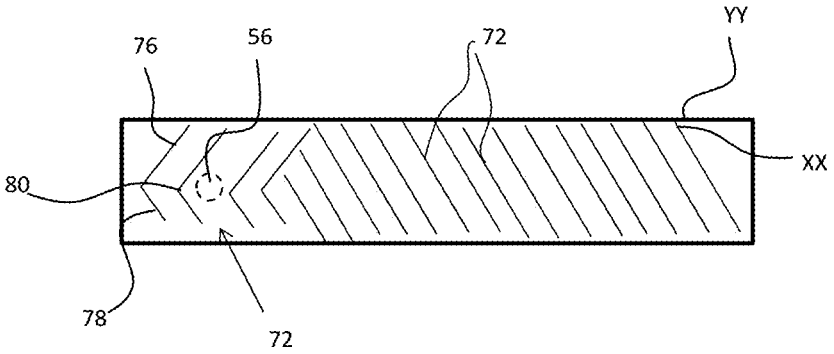

With reference to FIG. 5*e*, the wall of the cooling channel 60 having the highest heat flux, such as the leading edge wall for example, is identified as YY. In the illustrated, non-limiting embodiment, the leading edge of the skewed line trip strips 72*b*, identified as XX, is located adjacent to and in contact with the wall having the highest heat flux location YY, to maximize the local convective heat transfer coefficient at that location.

The plurality of trip strips 72 are arranged such that a distance exists between adjacent trip strips 72. The spacing of the trip strips 72 is selected so that the cooling airflow will initially contact a leading edge of a first trip strip 72 and separate from the inner diameter surface 74. Adequate spacing between adjacent trip strips 72 ensures that the cooling airflow reattaches to the inner diameter surface 74 before reaching a leading edge of the adjacent trip strip 72.

The plurality of trip strips 72, including at least one chevron shaped trip strip 72*a* are used to distribute the cooling airflow across the cooling channel 60 to provide adequate cooling to specific areas and minimize or eliminate local cavity regions exhibiting flow recirculation and/or regions of stagnated flow within the cooling channel 60. As illustrated and described herein, the at least one chevron shaped trip strip 72*a* is positioned adjacent the at least one inlet aperture 56 or within an impingement zone associated with the cooling channel 60. The chevron shaped trip strip 72*a* may be oriented such that the legs 76, 78 extend downstream, or alternatively, such that the apex 80 extends downstream with respect to the air flow through the cooling channel 60. In embodiments where the inlet aperture 56 includes a discrete feed hole, as shown in FIGS. 3 and 5*b*, the plurality of chevron shaped trip strips 72*a* may extend axially, in any direction from the inlet aperture 56, a distance of up to about ten times the diameter of the inlet hole, such as five times for example. In embodiments where the inlet aperture 56 is a side inlet (FIG. 5*a*), the chevron shaped trip strips 72*a* may extend over an axial length of the cooling channel 60 a distance of up to about ten times a radial height of the side inlet, such as between five times and ten times the radial height for example.

By positioning one or more chevron shaped trip strips 72*a* within an impingement zone, distribution of the airflow supplied thereto may be coordinated across the cooling channel 60 as needed. As it contacts the chevron shape, the airflow is evenly distributed and directed toward the walls 70 and the stagnated regions of flow. Further, the transition of the air flow from the at least one chevron shaped trip strip 72*a* to the one or more skewed line trip strips 72*b* promotes a more uniform distribution of internal convective heat transfer laterally across the cooling channel 60 by creating more local flow vorticity. This more uniform flow mitigates the formation of regions of low velocity flow and poor local heat transfer.

The configuration of the plurality of chevron shaped and/or skewed line trip strips 72*b* may direct and guide the cooling impingement air downstream of the discrete feed supply hole 56 to improve both lateral and stream-wise cooling channel 60 fill & heat transfer characteristics. Incorporation of alternate trip strip geometries in conjunction with each other as described herein enables the improved management of the convective heat transfer characteristics within the cooling channels 60 that are supplied cooling air using the discrete feed supply holes 56. The interaction of the coolant flow with the chevron and skewed line trip strips 72 enable the promotion of local coolant flow vortices, while also providing a means by which the thermal cooling boundary layer at the wall can be better directionally controlled and managed to increase local convective cooling heat transfer, as well as improved distribution of both local and average thermal cooling characteristics of the trip strip roughened surface, the opposite smooth wall, and smooth side walls.

Although the at least one chevron shaped trip strip 72*a* and the at least one skewed line trip strip 72*b* is illustrated and described relative to a BOAS 50, the trip strip configurations 72 may be incorporated into any cooling passageway extending between a first wall generally exposed to a gas path and a second wall separated from the first wall, such as in an airfoil and/or or platform 44*a* (FIG. 2) of a rotor blade 44 or within an airfoil and/or ID/OD platform end wall 51, 53 (FIG. 2) of a stator vane 46 for example.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

We claim:

1. A blade outer air seal assembly, comprising:

a blade outer air seal segment;

a plurality of cooling channels disposed in said blade outer air seal segment, the plurality of cooling channels extending at least partially between a first circumferential end portion and a second circumferential end portion;

a plurality of inlet apertures for providing a cooling airflow to the plurality of cooling channels;

a plurality of trip strips in said cooling channel for causing turbulence in said cooling airflow within the plurality of cooling channels;

wherein said plurality of trip strips include a plurality of chevron shaped trip strips having a first leg and a second leg joined together at an apex arranged adjacent said plurality of inlet apertures configured to direct said cooling airflow across an entire width of said plurality of cooling channels;

a plurality of single skewed line trip strips, wherein each single skewed linetrip strip is shaped as a single line and arranged at an angle to a path defined by the plurality of cooling channels;

wherein in a first channel of the plurality of cooling channels, with respect to said cooling airflow, the plurality of single skewed line trip strips are arranged at a first stream-wise end of the first channel and the plurality of chevron shaped trip strips are arranged at a second stream-wise end of the first channel; and the plurality of cooling channels are fluidly separated by circumferentially extending barriers that are generally parallel.

2. The assembly of claim 1, wherein the first stream-wise end is one of an upstream end and a downstream end of the first channel, and the second stream-wise end is another of the upstream end and the downstream end of the first channel.

3. The assembly of claim 1, wherein in at least one channel, with respect to said cooling airflow, at least one chevron shaped trip strip is upstream of at least one inlet.

4. The assembly of claim 1, wherein said plurality of chevron shaped trip strips, said plurality of chevron shaped trip strips are substantially identical.

5. The assembly of claim 1, wherein:

the plurality of single skewed line trips strip are arranged generally parallel to one of the first leg and the second leg of the plurality of chevron shaped trip strips; or the plurality of single skewed line trip strips are arranged generally at an angle to one of the first leg and the second leg of the plurality of at least one chevron shaped trip strips.

6. The assembly of claim 1, wherein a ratio of a height of said trip strips to a height of said cooling channel is between about 0.1 and 0.5.

7. The assembly of claim 1, wherein a leading edge of the plurality of skewed line trip strips is arranged adjacent to a portion of the cooling channel having a highest heat flux.

8. The assembly of claim 1, wherein the at least one inlet aperture includes a discrete feed hole, and the chevron shaped trip strips extend from the discrete feed hole a distance of up to about five times a diameter of the discrete feed hole.

9. The assembly of claim 1, wherein the at least one inlet aperture includes a side inlet, and the chevron shaped trip strips extend from the side inlet a distance of up to about ten times a radial height of the side inlet.

10. The assembly of claim 1, wherein the plurality of chevron shaped trip strips are arranged within an impingement zone adjacent at least one inlet aperture.

11. A gas turbine engine, comprising:

a compressor section;

a turbine section; and a gas turbine engine component comprising a blade outer seal assembly, the component having: a first wall defining a first circumferential end portion of the blade outer air seal assembly; the first wall providing an outer surface of the gas turbine engine component; and a second wall defining a second circumferential end portion of the blade outer air seal assembly; the second wall being spaced apart from the first wall; the first wall being a gas path wall exposed to a core flow path of the gas turbine engine; and the second wall being a non-gas path wall; and the blade outer air seal assembly; comprising:

a blade outer air seal segment;

a plurality of cooling channels disposed in said blade outer air seal segment, the plurality of cooling channels extending at least partially between the first circumferential end portion and the second circumferential end portion;

a plurality of inlet apertures for providing a cooling airflow to the plurality of cooling channels;

a plurality of trip strips in said cooling channel for causing turbulence in said cooling airflow within the plurality of cooling channels;

wherein said plurality of trip strips include a plurality of chevron shaped trip strips having a first leg and a second leg joined together at an apex arranged adjacent said plurality of inlet apertures configured to direct said cooling airflow across an entire width of said plurality of cooling channels;

a plurality of single skewed line trip strips, wherein each single skewed linetrip strip is shaped as a single line and arranged at an angle to a path defined by the plurality of cooling channels;

wherein in a first channel of the plurality of cooling channels, with respect to said cooling airflow, the plurality of single skewed line trip strips are arranged at a first stream-wise end of the first channel and the plurality of chevron shaped trip strips are arranged at a second stream-wise end of the first channel; and the plurality of cooling channels are fluidly separated by circumferentially extending barriers that are generally parallel.

12. The engine of claim 11, wherein the first stream-wise end is one of an upstream end and a downstream end of the first channel, and the second stream-wise end is another of the upstream end and the downstream end of the first channel.

13. The engine of claim 11, wherein in at least one channel, with respect to said cooling airflow, at least one chevron shaped trip strip is upstream of at least one inlet.

14. The engine of claim 11, wherein said plurality of chevron shaped trip strips, said plurality of chevron shaped trip strips are substantially identical.

15. The engine of claim 11, wherein:

the plurality of single skewed line trips strip are arranged generally parallel to one of the first leg and the second leg of the plurality of chevron shaped trip strips; or the plurality of single skewed line trip strips are arranged generally at an angle to one of the first leg and the second leg of the plurality of at least one chevron shaped trip strips.

16. The engine of claim 11, wherein a ratio of a height of said trip strips to a height of said cooling channel is between about 0.1 and 0.5.

17. The engine of claim 11, wherein a leading edge of the plurality of skewed line trip strips is arranged adjacent to a portion of the cooling channel having a highest heat flux.

18. The engine of claim 11, wherein the plurality of inlet apertures include a discrete feed hole, and the chevron shaped trip strips extend from the discrete feed hole a distance of up to about five times a diameter of the discrete feed hole.

19. The engine of claim 11, wherein the plurality of inlet apertures include a side inlet, and the chevron shaped trip strips extend from the side inlet a distance of up to about ten times a radial height of the side inlet.

20. The engine of claim 11, wherein the plurality of chevron shaped trip strips are arranged within an impingement zone adjacent at least one inlet aperture.

* * * * *